United States Patent [19]

Fujisawa et al.

[11] Patent Number: 4,960,611

[45] Date of Patent: Oct. 2, 1990

[54] METHOD OF REMEDYING COATING

[75] Inventors: Atsuhisa Fujisawa, Kobe; Masuo Ojima, Amagasaki; Kenji Wakabayashi, Kobe; Souji Omoto, Takarazuka; Toyokazu Shimizu, Osaka, all of Japan

[73] Assignee: Kansai Paint Company, Limited, Amagasaki, Japan

[21] Appl. No.: 250,643

[22] Filed: Sep. 29, 1988

[30] Foreign Application Priority Data

| | | | |
|---|---|---|---|
| Sep. 30, 1987 | [JP] | Japan | 62-248375 |
| Jun. 10, 1988 | [JP] | Japan | 63-144492 |
| Jun. 10, 1988 | [JP] | Japan | 63-144494 |

[51] Int. Cl.[5] ..... B05D 3/06

[52] U.S. Cl. ..... 427/43.1; 427/45.1; 427/53.1; 427/55; 427/56.1; 427/140; 427/142

[58] Field of Search ..... 427/43.1, 45.1, 53.1, 427/55, 56.1, 140, 142

[56] References Cited

U.S. PATENT DOCUMENTS

| | | | |
|---|---|---|---|
| 3,743,777 | 7/1973 | Hanus et al. | 427/53.1 |
| 4,009,364 | 2/1977 | Ladstüdtes | 427/53.1 |
| 4,249,966 | 2/1981 | Schnable | 427/53.1 |
| 4,321,307 | 3/1982 | Brayole et al. | 427/54.1 |
| 4,369,223 | 1/1983 | Phillips | 427/54.1 |
| 4,668,529 | 5/1987 | Blair | 427/142 |
| 4,684,535 | 8/1987 | Heineche et al. | 427/140 |
| 4,727,234 | 2/1988 | Oprysko et al. | 427/53.1 |

FOREIGN PATENT DOCUMENTS

| | | | |
|---|---|---|---|
| 3325251 | 1/1985 | Fed. Rep. of Germany | 427/140 |
| 52-35024 | 3/1977 | Japan | 427/140 |
| 55-79075 | 6/1980 | Japan | 427/142 |

*Primary Examiner*—Stanley Silverman

*Attorney, Agent, or Firm*—Armstrong, Nikaido, Marmelstein, Kubovcik & Murray

[57] ABSTRACT

A method of remedying a coating characterized by irradiating a minute defect in the coating due to the adhesion of a dust particle, oil droplet or the like with a laser beam having a cross section generally in conformity with the defect to sublime the dust particle, oil droplet or the like and the coating at the defective portion and form a minute cavity in the coating, filling a repair coating composition into the cavity and curing the composition.

16 Claims, 8 Drawing Sheets

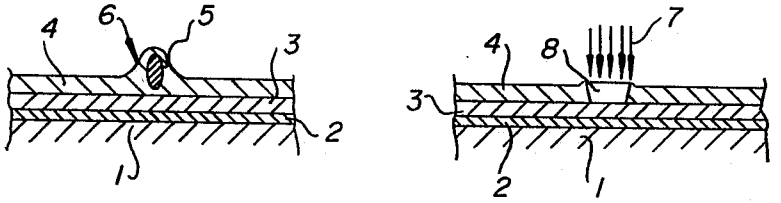
FIG. 4(a)
FIG. 4(b)
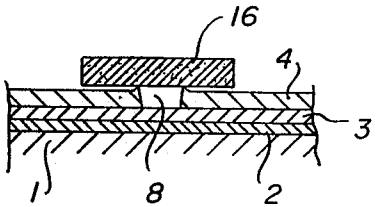
FIG. 4(c)
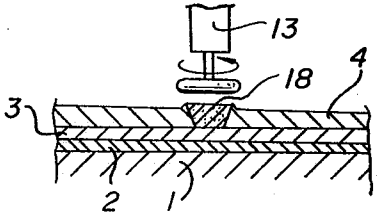
FIG. 4(e)
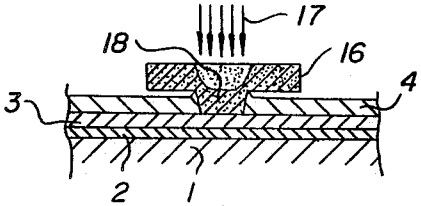
FIG. 4(d)
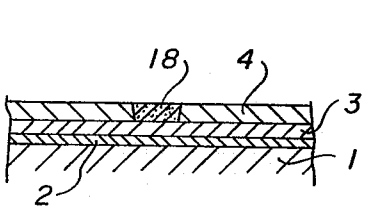
FIG. 4(f)

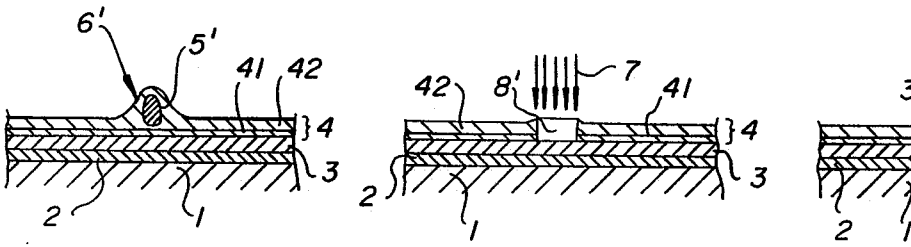
FIG. 6(a)
FIG. 6(b)
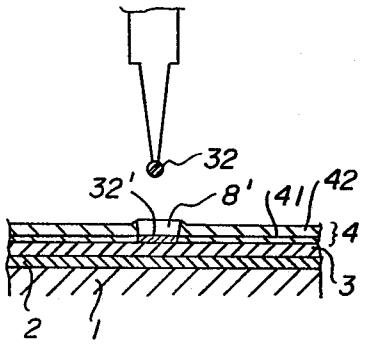
FIG. 6(c)
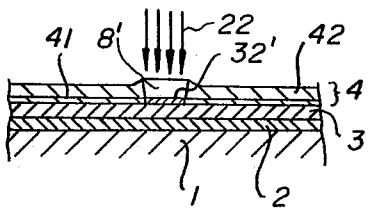
FIG. 6(d)
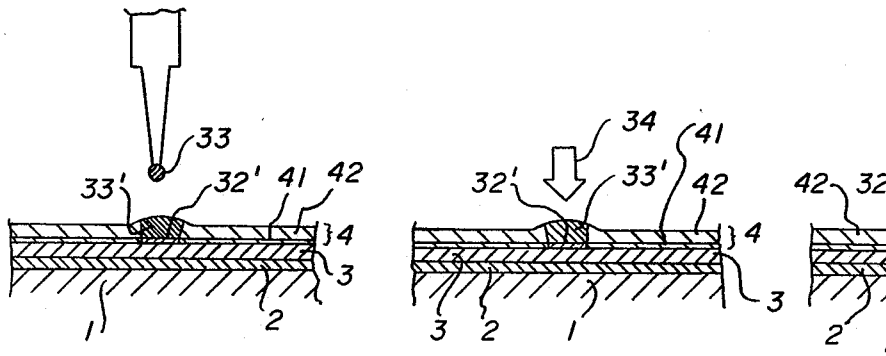
FIG. 6(e)
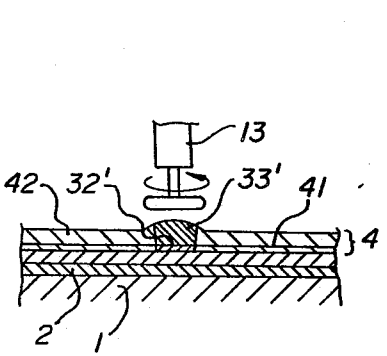
FIG. 6(f)
FIG. 6(g)
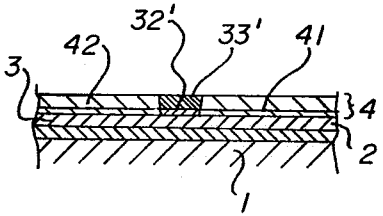
FIG. 6(h)

METHOD OF REMEDYING COATING

APPLICATION OF THE INVENTION

The present invention relates to a method of remedying minute defects in a coating which arise from adhesion of dust particles, oil droplets or the like.

PRIOR ART

For example in the process for coating the bodies of motor vehicles, the vehicle body as assembled is pretreated for degreasing and rust removal and thereafter subjected to the steps of electrodeposition of a primer and baking, intermediate coating and baking, polishing, top coating and baking, etc. in succession. When the resulting coating is found to be free from faults by inspecting the appearance, the vehicle body is transferred to the subsequent overall assembly line. If rejected by the inspection, the vehicle body is sent to a remedy line separately provided for the remedy of the defects and then inspected again to check the appearance of the remedied portion. Most of the defects in the coating are craters created by the adhesion of suspended silicone oil droplets and the like repelling the coating composition, or projections produced by the inclusion of dust particles in the coating.

FIG. 14 shows an example of method of remedying detects in a coating.

FIG. 14 (*a*) is an enlarged section showing a coating comprising an electrodeposited primer layer 53, an intermediate coat layer 54 and a topcoat layer 55 and formed on a vehicle body steel plate 52 by coating and baking. It is seen that the topcoat layer 55 has a defect 57 in the form of a projection with a diameter of X and formed by a dust particle 56 enclosed in the layer. With the conventional method of remedy, the defect 57 is first treated with a grinder 58, sandpaper or the like to completely remove the dust particle 56 as shown in FIG. 14 (*b*). When the defect is a crater due to the adhesion of silicone oil, the silicone oil or like deposit is completely removed. Next, a repair coating composition 61 is applied to the ground portion 60 with a spray gun 59 (see FIG. 14 (*c*)), and the applied composition 61 is dried, or baked with a heat source 62 (see FIG. 14 (*d*)). The obtained coating 64 is polished with a rotary buff 63 or the like (see FIG. 14 (*e*)) to level the coating for finishing as seen in FIG. 14 (*f*).

The conventional remedy method described has the following problems.

(I) The defective portion is ground with the grinder having a disk which is exceedingly greater than the minute defect or with sandpaper or the like having a large area, so that the ground portion extends over a wide area and possibly extends to the primer layer or to the steel plate. This impairs the properties of the repair coating formed thereon.

(II) When applied with the spray gun, the repair coating composition is provided over an area greater than the ground portion and must therefore be used in an increased amount, while the heat source for drying and baking needs to be disposed over the wider area. Consequently, the remedy consumes a large quantity of energy.

(III) Since the grinding, coating, drying and polishing must be done over a wide area as stated above, the overall procedure requires, for example, at least 30 minutes. Accordingly, there arises a need to provide a separate remedy line, which renders both the operation and the equipment costly.

(IV) The procedure for forming a homogeneous repair coating over an increased area requires a skillful worker.

These problems are encountered not only in coating the bodies of motor vehicles but also in coating a wide variety of common articles such as a casing for electric products. It is therefore desired to overcome these problems.

SUMMARY OF THE INVENTION

An object of the present invention is to solve the foregoing problems and to provide a method of remedying the defects in coatings rapidly and easily with a repair coating which retains the desired properties almost free of deterioration.

The above object can be fulfilled by a method of remedying a coating characterized by irradiating a minute defect in the coating due to the adhesion of a dust particle, oil droplet or other defect causing agent with a laser beam having a cross section generally in conformity with the defect to sublime the dust particle, oil droplet or the like and the coating at the defective portion and form a minute cavity in the coating, filling a repair coating composition into the cavity and curing the composition.

The repair coating composition filled in the minute cavity can be cured by projecting a laser beam onto the filled portion, bringing a hot gas into contact with the composition, irradiating the composition with infrared or far infrared radiation, irradiating the filled portion with an electron beam, or allowing the composition to stand at room temperature for a required period of time (for drying or crosslinking reaction).

An ultraviolet-curable repair coating composition can be filled into the minute cavity and then irradiated with ultraviolet radiation for curing.

When the substrate coated is electrically conductive, the repair coating composition filled in the minute cavity can be cured by the electromagnetic induction heating of the filled portion and the portion of the substrate around the filled portion.

The minute cavity can be filled with (i) a repair coating composition of the same color as the coating or a transparent repair coating composition, or (ii) a repair coating composition of the same color as the coating in its bottom portion and then with a transparent coating composition over the first composition in which case the repair compositions can be applied by double filling.

The double filling procedure can be performed by placing the color repair composition into the bottom portion of the cavity, curing the composition, then placing the transparent repair composition into the cavity and thereafter curing the transparent repair composition. The two compositions can be cured by one of the foregoing curing means.

The double filling procedure can be performed further by placing the color repair composition into the bottom portion of the cavity, placing the transparent repair composition into the cavity over the color composition and thereafter curing the two compositions in the cavity. In this curing step, the two repair compositions can be cured by one of the foregoing curing means.

The laser beam for forming the minute cavity in the coating and/or the laser beam for curing the repair coating composition can be applied in an inert gas atmosphere, which is preferably heated.

According to the present invention, the repair coating composition can be a solid or semisolid composition. This composition can be filled into the cavity by placing the composition on the coating so as to cover the cavity therewith and then projecting a laser or electron beam onto the composition over an area generally corresponding to the cavity to melt the composition.

Further according to the invention, the repair coating composition can be a liquid composition, which can be placed into the cavity dropwise.

The method of the invention can be practiced using a solid, semisolid or liquid coating composition.

The solid coating composition (to be hereinafter interpreted as including the semisolid composition) is preferably one which is not flowable at room temperature but becomes flowable on melting when exposed to an adjusted output of laser or electron beam. The solid coating composition consists essentially of a base resin, and further comprises a curing agent, curing catalyst and pigment selected from (at least one of a coloring pigment, a metallic pigment, dye and extender pigment) admixed therewith as required. The solid coating composition contains water, organic solvent, plasticizer or like liquid in such a small amount as not to flow at room temperature or is totally free from the liquid and can be molded by a known process.

Examples of base resins which are usable are alkyd resin, polyester resin, epoxy resin, acrylic resin, urethane resin, fluorocarbon resin, vinyl resin and the like. Examples of useful curing agents are melamine resin (inclusive of alkyl-etherified product), polyisocyanate compound (inclusive of blocked product), polyamide resin, polymerizable unsaturated monomer, carboxyl-containing compound and the like. A suitable agent can be selected in accordance with the crosslinking reactivity and the kind of functional group of the base resin.

When the solid or semisolid coating composition to be used has a tacky surface, the composition becomes convenient to handle if affixed to a backing sheet, such as polyethylene sheet, having no coating forming ability.

On the other hand, the liquid coating composition consists essentially of the above-mentioned base resin, and further comprises a curing agent, curing catalyst, pigment, etc., such as those exemplified above, as admixed with the base resin as required. The liquid coating is in the form of a solution or dispersion of these components in water and/or organic solvent, and is flowable at room temperature.

When allowed to stand at room temperature or heated (for example, by irradiation with a laser beam, electron beam or infrared or far infrared radiation, by electromagnetic induction, or with hot air), the solid or liquid coating composition exhibits a phenomenon such as (I) evaporation of solvent or like volatile component, (II) oxidation polymerization, (III) crosslinking reaction through polymerization, condensation or addition reaction, (IV) melting, (V) fusion reaction (vaporization of the dispersant to result in assembling or agglomeration of base resin particles, forming a continuous coating) or the like, whereby a cured coating is formed.

The method of the invention has the following advantages. Since the minute defect in the coating is irradiated with a laser beam having a cross section in conformity with the defect to sublime the defective portion, the defective portion can be removed to the desired depth within a very short period of time and within a greatly limited area, while the minute cavity formed by the removal of the defective portion can be filled with a minimized amount of repair coating composition. This serves to diminish the consumption of energy for curing the composition. Moreover, the remedy, which is limited to a small area, is almost unlikely to impair the properties of the entire coating. The remedied portion is easy to finish, and the repair coating operation does not require particular skill. The irradiation with the laser beam, when conducted in an inert gas atmosphere, precludes discoloration of the coating. Furthermore, a wide variety of repair coating compositions are usable which are curable at low temperature (e.g. room temperature) to high temperature. Since the remedy can be accomplished within a greatly shortened period of time as stated above, defects can be remedied in the usual coating line without the necessity of providing an additional remedy line.

Other objects and features of the invention will become apparent from the following description of embodiments with reference to the accompanying drawings.

BRIEF DESCRIPTION OF THE DRAWINGS

FIG. 4 to 7 are diagrams individually showing stepwise different modes of practicing the remedying method of the invention;

EMBODIMENTS

Figure 2:
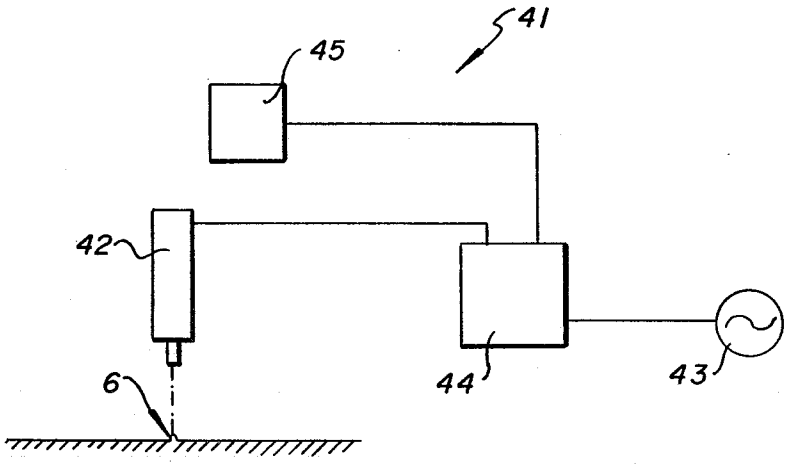
FIG. 2 is a view schematically showing an example of laser beam machine for use in the method of the invention.
Figure 5A:
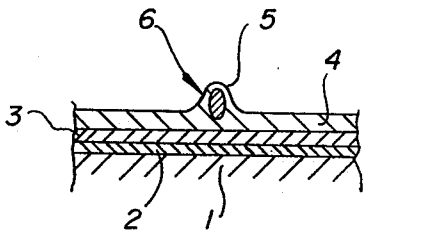
Figure 5B:
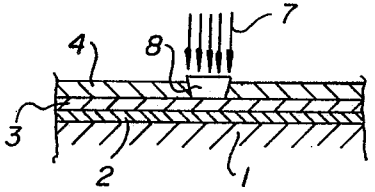
Figure 5C:
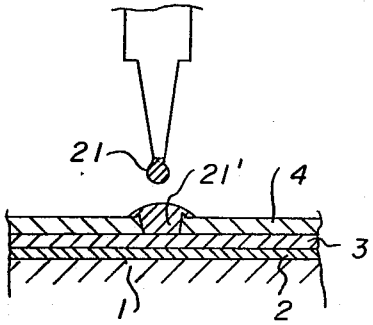
Figure 5D:
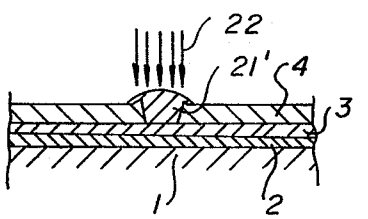
Figure 5E:
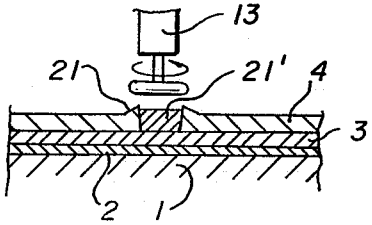
Figure 5F:
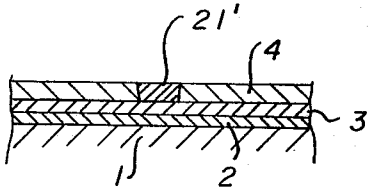
Figure 7A:
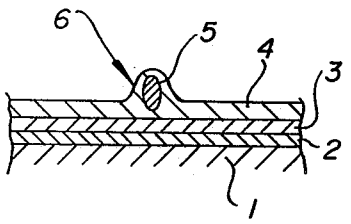
Figure 7B:
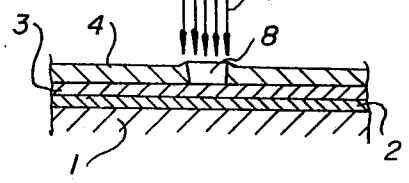
Figure 7C:
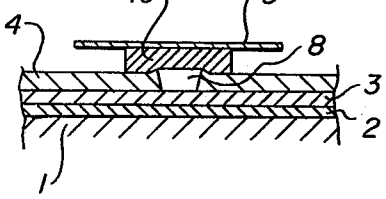
Figure 7D:
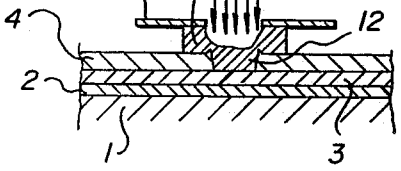
Figure 7E:
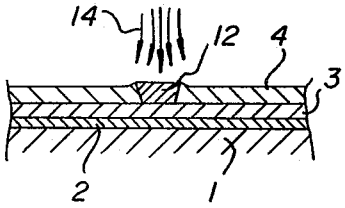
Figure 7F:
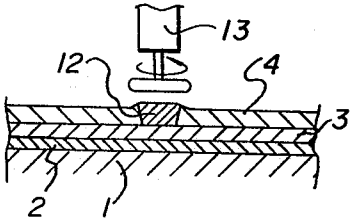
Figure 7G:
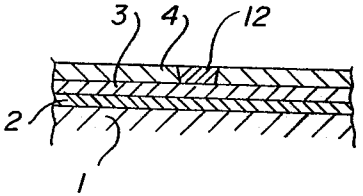

FIG. 1 shows stepwise a method of the invention as practiced for remedying a defect created in a coating on the body of a motor vehicle by dust particle enclosed in the coating. Like FIG. 14 (*a*), FIG. 1 (*a*) shows on an enlarged scale a minute defect 6 occurring in the coating which is formed on the steel plate of the vehicle body and comprises an electrodeposited primer layer 2, an intermediate coat layer 3 and a topcoat layer 4. The defect is in the form of a projection produced by a dust particle 5 enclosed in the topcoat layer 4. The defect 6 in the coating is remedied by the following steps. First, as shown in FIG. 1 (*b*), a laser beam 7 having a cross section generally in conformity with the defect 6 is projected onto the defect 6 perpendicular thereto to remove the defective portion including the dust particle 5 by sublimation to form a minute cavity 8 in the coating. FIG. 2 shows an example of a laser beam machine for emitting the laser beam 7.

The laser beam machine 41 comprises a laser oscillator 42 for emitting a He-Ne laser beam or like as a positioning visible laser beam and a carbon dioxide laser beam, YAG laser beam or like as a machining laser beam 7, a control unit 44 connected to a power supply 43 for controlling the output and duration of emission of the beam 7, and an operation unit 45 for operating the control unit 44. The laser beam machine 41 is first positioned properly for the defect 6 using the visible laser beam, and the machining laser beam is then projected onto the defect with an adjusted output, whereby the defective portion 6 to be remedied is removable by sublimation to the desired depth and width to form the minute cavity 8. The depth can be the thickness of the topcoat layer 4, the combined thickness of the layer 4 and the intermediate coat layer 3, or the thickness of a transparent film when the topcoat layer 4 comprises a color film and the transparent film over the color film. The minute cavity 8 can be formed alternatively by a laser unit 42' shown in FIG. 3. The laser unit 42' comprises a laser oscillator 46 for emitting a visible laser beam 7', another laser oscillator 47 for emitting a machining laser beam 7, and a housing 50 having a discharge tube 51 and accommodating the two oscillators 46, 47. The visible laser beam 7' emitted by the oscillator 46 for positioning is reflected from a prism 48 at a right angle with the direction of emission, further reflected at a zinc-selenium coated mirror 49, passed through the discharge tube 51 and projected onto the desired site. The machining laser beam 7 is transmitted through the zinc-selenium coated mirror 49, passed through the tube 51 like the beam 7' and projected onto the site. Nitrogen gas or like inert gas N is introduced into the housing 50 of the laser unit 42'. The inert gas N filling the housing 50 is discharged through the tube 51 and applied to the desired site, i.e. the defective portion 6, and the neighboring portion to hold these portions in the atmosphere of the inert gas N. This inhibits the discoloration (due to degradation such as carbonization of the resin) of the coating around the defect 6 due to the heat of the machining laser beam 7. Further the inert gas N circulates through the interior of the housing 50 and is discharged while cooling the laser oscillators 46, 47. This enables the oscillators 46, 47 to produce the beam output, 7, 7' with good stability regardless of the operating time.

Next, a repair coating composition is filled into the minute cavity 8 formed by the above procedure. In the example shown in FIG. 1, the composition used is a tacky solid coating composition 10 adhered to one side of a sheet 9. First, the sheet 9 is placed over the cavity 8 formed in the coating to affix the composition 10 to the coating over the cavity 8 (see FIG. 1 (*c*)). Using the laser beam machine 41 as already positioned in place or as positioned subsequently by the projection of the visible laser beam, an adjusted output of machining laser beam 11 is projected onto an area generally corresponding to the cavity 8 to place the composition 10 into the cavity 8 on melting (see FIG. 1 (*d*)). The thickness of the composition 10 to be adhered to the sheet 9 is suitably determined so that the cavity 8 can be fully filled with the composition. The sheet 9 can be made of polyethylene resin or the like. After the composition 10 has been affixed to the coating, the sheet 9 may be removed before the composition is filled into the cavity 8 by the application of the beam 11. The repair composition 10 may be filled into the cavity 10 in an atmosphere of inert gas using the laser unit 42' with the application of the inert gas. The composition filled portion 12 obtained is further irradiated with the laser beam 11 to cure the composition in the portion 12 by heating..

Figure 1A:
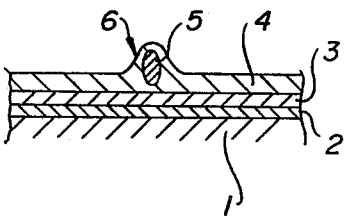
FIG. 1 is a diagram showing stepwise a remedying method embodying the invention.
Figure 1B:
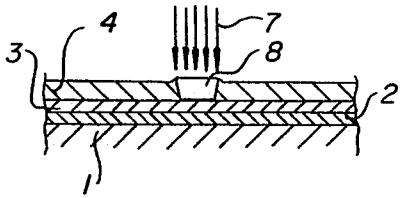
Figure 1C:
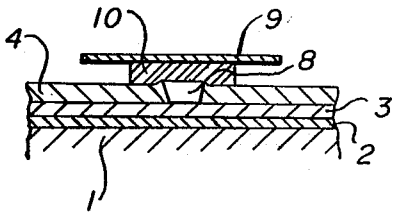
Figure 1D:
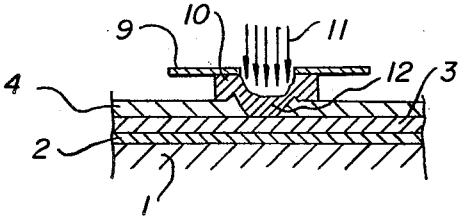
Figure 1E:
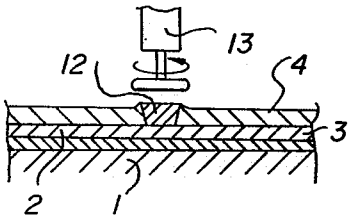
Figure 1F:
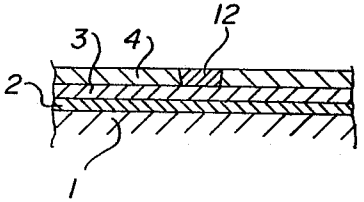
Figure 3:
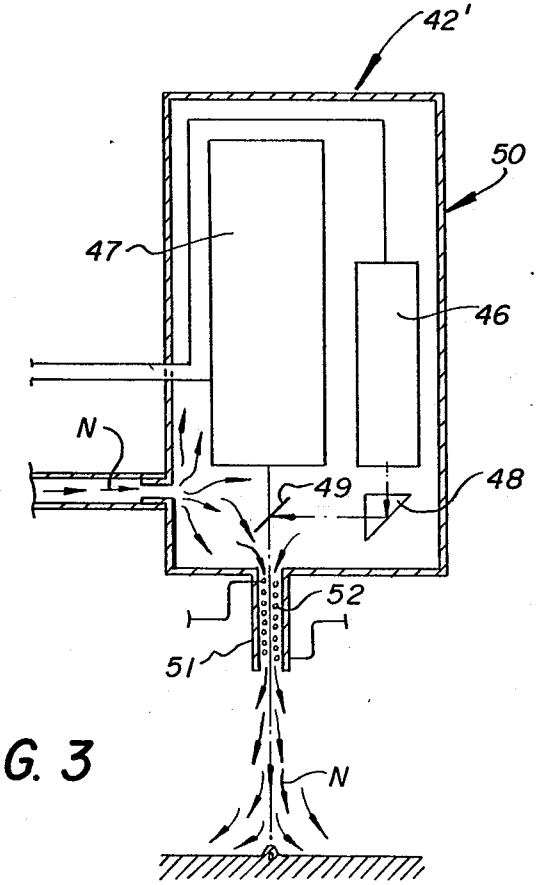
FIG. 3 is a front view in vertical section showing an example of laser oscillator.

It is desirable to cure the composition 12 in the atmosphere of inert gas N using the laser unit 42' since the neighboring coating portion can be prevented from discoloration. More preferably, the inert gas is heated. With reference to FIG. 3, the inert gas N can be heated by being passed through the discharge tube 51 of the housing 50 of the laser unit 42', with a coiled heater 52 provided inside the tube 51. The inert gas, when heated, serves to rapidly cure not only a coating composition which is curable at a high temperature (one curable with a high output of laser beam) but also a coating composition which cures at a low temperature (one curable with a low output of laser beam). When the inert gas is not heated, the low temperature-curable composition, which usually needs to be irradiated with the low-output laser beam, requires a prolonged period of time for curing because the composition is greatly affected by the heat release action of the steel plate 1 having high heat conductivity, whereas the atmosphere of hot inert gas N compensates for the heat loss due to the heat release, enabling the curing of compositions within a short time.

The heating for the compensation of the heat release is not limited to the heating by the inert gas but can also be accomplished by various heating means such as hot air, induction heater and infrared radiation.

After the composition has been cured, the composition filled portion 12 is finished by leveling with by a grinding stone, small rotary buff 13 or the like (see FIG. 1 (*e*), (*f*)).

In this way, the defect in the coating can be remedied by removing the defective portion over a minimized area through sublimation using a laser beam, filling only a required amount of repair coating composition into the cavity resulting from the removal of the defective portion and curing the filled composition only by the irradiation with a laser beam. The present method therefore diminishes the consumption of the repair coating composition and the energy and can be practiced rapidly and easily without requiring the use of one skilled in the coating art. Table 1 is given below wherein the method of the invention is compared with the conventional method in remedy time.

TABLE 1

| | Work Time (seconds) | | | |
|---|---|---|---|---|
| Steps | Method of Invention | | Conventional Method | |
| Removal of defective portion | Positioning of laser beam machine | 30 | | 60 |
| | Irradiation with beam | 2 | | |
| Filling of repair composition or coating | Filling | 10 | Coating | 180 |
| Curing or drying/baking of repair composition | Curing | 5 | Drying/baking | 1800 |
| Polishing for finishing | | 30 | | 120 |
| Total | | 77 | | 2160 |

Table 1 shows that the remedy work by the method of the invention requires as short as above 1/28 of the period of time required for the remedy work by the conventional method. This makes it possible to remedy defects in the coating within the usual coating line, eliminating the need for an additional remedy line.

Although the embodiment described above in detail is concerned with a method of remedying a defect created in the coating by enclosing a dust particle, the same method as above is useful for remedying a defect in the form of a crater which is formed in the coating by the adhesion of a suspended silicone oil droplet or the like repelling the coating composition. In this case, the defective portion is irradiated with an output of machining laser beam suited to remove the oil droplet or like deposit through sublimation.

FIG. 4 shows another embodiment of the invention wherein a nontacky solid repair coating composition is used. Like FIGS. 1 (*a*) and (*b*), FIGS. 4 (*a*) and (*b*) respectively show a coating having a defect 6, and a minute cavity 8 formed in the coating. As seen in FIG. 4 (*c*), a pelletized repair coating composition 16 prepared by the compression molding of a powder or thermally meltable coating composition is placed on the coating over the cavity 8. Next, a laser beam 17 is projected onto the composition 16 over an area generally corresponding to the cavity 8 to cause the composition 16 to flow into the cavity 8 on melting (see FIG. 4 (*d*)). Like the tacky solid composition 10, the thickness of the pelletized composition 16 is suitably determined according to the diameter and depth of the cavity 8. The filled composition 18 is further irradiated with the laser beam 17 and cured by heating. The surface of the cured composition 18 is thereafter polished by rotary buff 13 or the like (see FIG. 4 (*e*)) and thereby leveled for finishing as shown in FIG. 4 (*f*).

As is the case with the embodiment shown in FIG. 1, the laser unit 42′ of FIG. 3 is usable for projecting a laser beam in an atmosphere of inert gas N to preclude the discoloration of the coating. The composition 18 can be cured rapidly in the atmosphere of inert gas N as heated. Instead of the laser beam shown in FIGS. 1 (*d*) and 4 (*d*) for melting and/or curing the composition, an electron beam is usable.

FIG. 5 shows another embodiment of method of the invention. Like FIGS. 1 (*a*) and (*b*), FIGS. 5 (*a*) and (*b*) respectively show a coating having a defect 6, and a minute cavity 8 formed in the coating. With this embodiment, a liquid repair coating composition 21 is used which is filled dropwise into the cavity 8 a shown in FIG. 5 (*c*). Using the laser beam machine 41 as already positioned in place or as subsequently positioned by the projection of the visible laser beam, the liquid composition 21′ in the cavity is irradiated with a machining laser beam 22 over an area generally corresponding to the cavity 8 and thereby heated for curing (see FIG. 5 (*d*)). The liquid composition around the periphery of the cavity 8 is not exposed to the laser beam 22, remains uncured and can therefore be easily wiped off. The cured composition 21′ in the cavity 8 is thereafter polished by rotary buff 13 or the like (see FIG. 5 (*e*)) as in the above embodiments and is thereby leveled for finishing (see FIG. 5 (*f*)).

Thus, when the liquid coating composition 21 is used, the defect 6 can be remedied more easily without necessitating the melting of the composition before filling into the cavity 8.

Of course also in this case, the laser unit 42′ shown in FIG. 3 is usable for the application of laser beam in an atmosphere of inert gas N while preventing the discoloration of the coating (except when the composition is of the oxidation drying type). The composition 21 can be cured rapidly when the gas N is heated.

FIG. 6 is an embodiment of method of the invention wherein a liquid color coating composition 32 and an ultraviolet-curable transparent coating composition 33 are used as remedy coating compositions. FIG. 6 (*a*) shows a topcoat layer 4 composed of a color coat 41 and a transparent coat 42 over the color coat 42, and a minute defect 6′ produced by a duct particle 5′ enclosed in the topcoat layer 4. Like FIG. 1 (*b*), FIG. 6 (*b*) shows a minute cavity 8′ formed in the coating by removing part of topcoat layer 4 by the projection of a laser beam. With reference to FIG. 6 (*c*), the liquid color composition 32, which has the same color as the color coat 41, is placed dropwise into the bottom portion of the minute cavity 8′ to the same thickness as the thickness of the color coat 41 and irradiated with the same machining laser beam 22 as described with reference to FIG. 5 to heat the composition 32′ for curing (see FIG. 6 (*d*)). As seen in FIG. 6 (*e*), the ultraviolet-curable transparent composition 33 is then placed dropwise over the cured color composition 32′ to fill the cavity 8′. Subsequently, the cavity 8′ is irradiated with ultraviolet radiation 34 to cure the transparent composition 33′ (see FIG. 6 (*f*)). The ultraviolet radiation can be applied concentrically on the composition using, for example, a thin optical fiber connected to an ultraviolet radiation generator. As in the foregoing embodiments, the surface of the cured transparent composition 33′ is polished (see FIG. 6 (g)) and thereby leveled for finishing (see FIG. 6 (*h*)).

With the present embodiment, the amount of the color compsition to be cured with the laser beam can be reduced by an amount corresponding to that of the transparent composition, whereby the period of irradiation with the laser beam can be correspondingly shortened. The method of this embodiment is advantageously usable for remedying, for example, a metallic coating which comprises a metallic color coat and a transparent coat formed thereon. Further the use of the ultraviolet-curable coating composition assures a rapid remedy of the coating. Instead of the ultraviolet-curable transparent composition, also usable is a transparent coating composition which can be cured at room temperature or which is curable by some other means.

With the embodiment shown in FIG. 6, the color composition 32 is cured with a laser beam, and the transparent composition 33 is thereafter filled in and cured with ultraviolet radiation. Alternatively the color composition can be any of suitable color compositions which are curable by means other than irradiation with the laser beam, such as standing at room temperature, contacting with a heated gas, irradiation with infrared, far infrared, ultraviolet or electron beam or electromagnetic induction. The transparent composition is subsequently filled in and may be cured by irradiation with a laser beam or by one of said curing means. Alternatively, the transparent composition may be filled in before the color composition in the cavity 8′ is cured, followed by curing of the two compositions by means selected, according to the curing characteristics of coating compositions, from a laser beam and the abovementioned other means than laser beam. The color composition and/or the transparent composition need not always be liquid but can be solid. In this case, the composition is filled into the cavity by being irradiated with an adjusted output of laser or electron beam.

Figure 8:
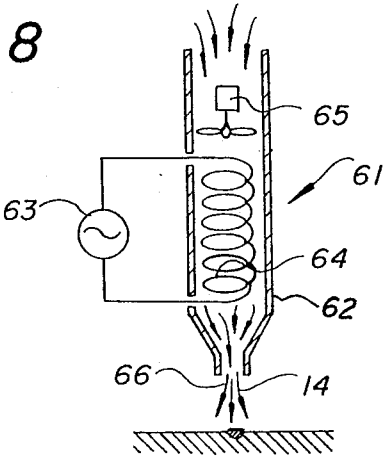
FIG. 8 is a front view in vertical section schematically showing an example of hot air supply device.

FIG. 7 shows another embodiment of method of the invention. The steps shown in FIGS. 7 (*a*) to (*d*) of this embodiment are performed in the same manner as already described with reference to FIG. 1. Subsequently, the filled composition 10 is exposed to hot air 14 supplied to the composition filled portion 12 as seen in FIG. 7 (*e*) and is thereby heated for curing. The hot air 14 can be supplied by a hot air supply device 61 shown in FIG. 8. The device 61 comprises a tube 62 having openings at its opposite ends and tapered toward one of the open ends, a coiled electric heater 64 disposed inside the tube 62 and connected to a power supply 63, and a blower 65 for introducing air into the tube 62 toward the heater 64. The air heated by the electric heater 64 is discharged through the tapered open end 66 of the tube 62. The hot air 14 can be applied concentrically to the composition filled portion 12 by the device 61 to rapidly cure the filled composition 10.

Figure 9:
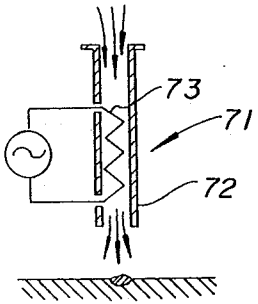
FIG. 9 is a front view in vertical section schematically showing an example of hot gas supply device.

FIG. 9 shows a hot gas supply device 71 which comprises a tube 72 of small diameter having opposite open ends, and an electric heater 73 disposed within the tube 72. An inert gas or like gas is supplied to the tube 72 through one of its open ends, heated by the heater 73 and discharged from the other open end on heating. This device 71 produces the same effect as the device 61. The use of inert gas serves also to prevent the discoloration of the coating (due to carbonization or like degradation of the resin).

Figure 10:
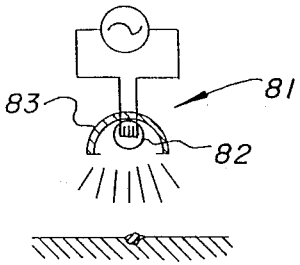
FIG. 10 is a front view in vertical section schematically showing an example of infrared irradiation device.
Figure 11:
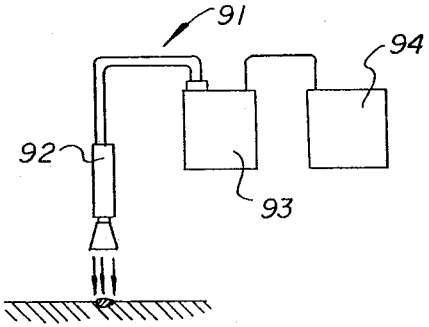
FIG. 11 is a front view schematically showing an example of electron beam irradiation device.
Figure 14A:
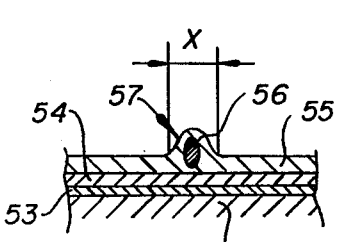
FIG. 14 is a diagram showing stepwise a conventional method of remedying coatings.
Figure 14B:
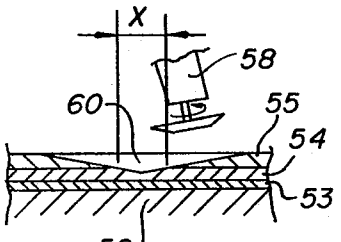
Figure 14C:
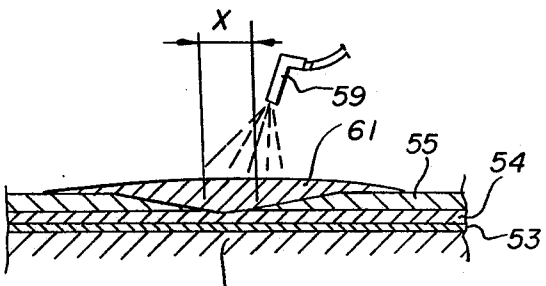
Figure 14D:
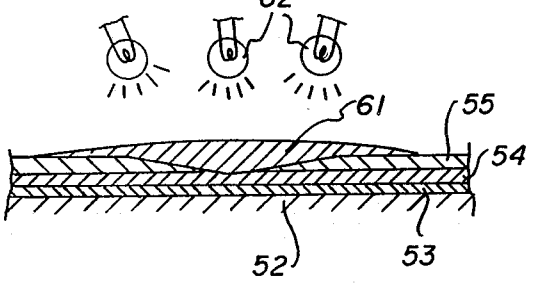
Figure 14E:
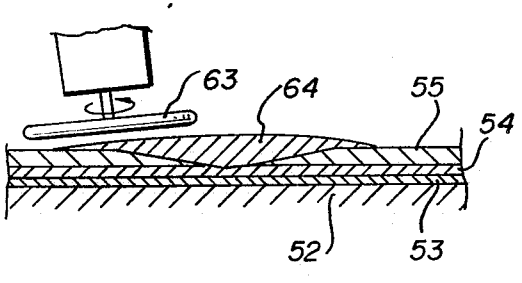
Figure 14F:
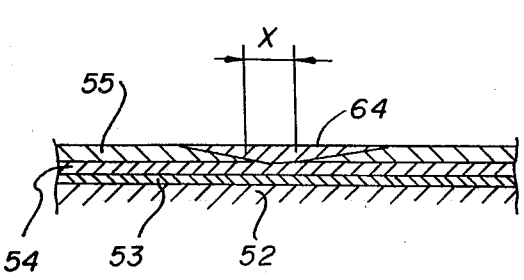

Instead of supplying the hot air 14 to the composition filled portion 12 for curing the filled composition 10, the filled portion 12 can be irradiated with infrared or far infrared radiation to cure the composition. An electron beam is also usable for curing. For the irradiation with infrared or far infrared radiation (hereinafter referred to as "infrared radiation"), an infrared irradiation device 81 shown in FIG. 10 is usable which comprises an infrared ray lamp 82 and a semispherical reflector 83 for reflecting the infrared radiation from the lamp 82 toward specified direction. For the irradiation with the electron beam, an electron beam irradiation device 91 shown in FIG. 11 is usable which comprises an electron beam accelerator 92, a high-voltage generator 93 for supplying a high voltage to the accelerator 92 and a control unit 94 for controlling the generator 93.

Figure 12:
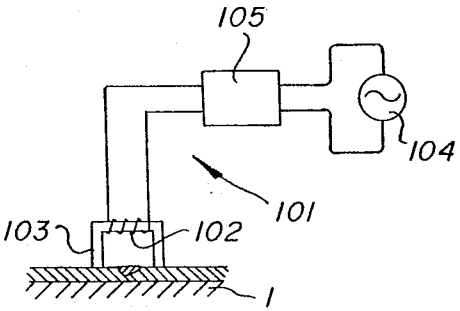
FIG. 12 is a front view schematically showing an example of induction heater.

The filled composition 10 may be cured by drying at room temperature or through a crosslinking reaction or like reaction at room temperature. Alternatively, the composition filled portion 12 or the portion of the vehicle body steel plate 1 around the filled portion 12 may be heated by electromagnetic induction to thereby cure the filled composition 10. For this purpose, an induction heater 101 shown in FIG. 12 is usable which comprises a U-shaped core 103 placed in the form of a gate over the coating and having an induction coil 102 wound therearound, and a control unit 105 connected to a power supply 104 for passing current through the induction coil 102 for producing an eddy current on the steel plate 1 to heat the plate 1 with the Joule heat due to the eddy current. The induction heater 101 may be provided with a temperature sensor (not shown) for detecting the temperature of the steel plate 1 and feeding the resulting detection signal to the control unit 105, whereby the steel plate 1 can be maintained at a substantially constant elevated temperature.

Figure 13:
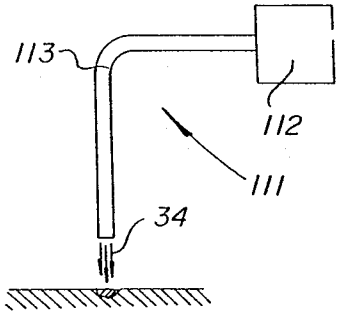
FIG. 13 is a front view schematically showing an example of ultraviolet irradiation device.

The ultraviolet-curable repair coating composition, when used, can be rapidly cured by irradiation with ultraviolet radiation using an ultraviolet irradiation device 111 shown in FIG. 13. The device 111 has a thin optical fiber 113 connected to an ultraviolet radiation generator 112 for applying the radiation concentrically to the repair composition. A transparent coating composition capable of transmitting ultraviolet radiation is especially advantageously usable as the composition of this type.

After the filled composition has been cured, the composition filled portion 12 is leveled with a grinding stone, small rotary buff 13 or the like for finishing.

The embodiment shown in FIGS. 7 to 13 has the same advantage as those already described. Stated more specifically, the coating composition can be cured in 5 to 120 seconds, and the overall work can be performed in 77 to 192 seconds. As will be apparent from the comparison between the present method and the conventional method listed in Table 1, the remedy work according to the method of invention requires as short as about 1/11 to about 1/28 of the time taken by the conventional method. This makes it possible to remedy defects in the coating within the usual coating line, eliminating the need for an additional remedy line.

The method of the invention is usable not only for the coating on the bodies of motor vehicles but also for the coatings on a wide variety of common articles such as casings of electric products.

We claim:

1. A method of remedying a coating characterized by irradiating a minute defect in the coating due to the adhesion of a defect causing agent with a laser beam, having a cross section generally in conformity with the defect, to sublime the defect causing agent and the coating at the defective portion and to form a minute cavity in the coating, filling a repair coating composition into the cavity and curing the composition.

2. A method as defined in claim 1 wherein the repair coating composition filled in the minute cavity is cured by irradiating the filled portion with a laser beam.

3. A method as defined in claim 1 wherein the repair coating composition filled in the minute cavity is cured by bringing a heated gas into contact with the composition.

4. A method as defined in claim 1 wherein the repair coating composition filled in the minute cavity is cured by irradiating the composition with infrared or far infrared radiation.

5. A method as defined in claim 1 wherein the repair coating composition filled in the minute cavity is cured by irradiating the composition filled portion with an electron beam.

6. A method as defined in claim 1 wherein the repair coating composition filled in the minute cavity is cured by being allowed to stand at room temperature for a required period of time.

7. A method as defined in claim 1 wherein the repair coating composition filled in the minute cavity is an ultraviolet-curable composition and is cured by irradiating the composition filled portion with ultraviolet radiation.

8. A method as defined in claim 1 wherein the coating is formed on an electrically conductive substrate, and the repair coating composition filled in the minute cavity is cured by heating the composition filled portion and the portion of the substrate around the filled portion by electromagnetic induction.

9. A method as defined in claim 1 wherein a repair coating composition having the same color as the coating is placed into the bottom portion of the minute cavity, and a transparent repair coating composition is placed into the cavity over the color composition to fill the cavity.

10. A method as defined in claim 9 wherein the color coating composition placed into the bottom portion of the cavity is cured, and the transparent coating composition is thereafter filled into the cavity and cured, the two compositions being cured by the composition curing means defined in any one of claims 2 to 8.

11. A method as defined in claim 9 wherein after the color coating composition and the transparent coating composition have been filled into the cavity, the two compositions in the cavity are cured by the composition curing means defined in any one of claims 2 to 8.

12. A method as defined in claim 1 wherein the irradiation with the laser beam for forming the minute cavity in the coating is effected in an inert gas atmosphere.

13. A method as defined in claim 2 wherein the irradiation with the laser beam for curing the repair coating composition is effected in an inert gas atmosphere.

14. A method as defined in claim 13 wherein the inert gas is used as heated.

15. A method as defined in claim 1 wherein the repair coating composition is a solid or semisolid coating composition, and the composition is filled into the cavity by placing the composition on the coating over the cavity and projecting a laser beam or electron beam onto the composition over an area generally corresponding to the cavity to melt the composition.

16. A method as defined in claim 1 wherein the repair coating composition is liquid, and the liquid composition is placed dropwise into the minute cavity to fill the cavity.

* * * * *